United States Patent [19]

Barthelemy et al.

[11] Patent Number: 4,770,255

[45] Date of Patent: Sep. 13, 1988

[54] ARRANGEMENT FOR UNDERWATER DRILLING OF FOUNDATIONS

[75] Inventors: Hervé Barthelemy, Croissy-sur-Seine; Karl Bollinger, Rueil Malmaison; Michel Brochier, Palaiseau; Maurice Gau, Maurepas; Yves Legendre, Balloy, all of France

[73] Assignee: Soletanche, Nanterre, France

[21] Appl. No.: 39,584

[22] Filed: Apr. 16, 1987

[30] Foreign Application Priority Data

Apr. 17, 1986 [FR] France ..... 86 05529

[51] Int. Cl.[4] ..... E21B 7/124

[52] U.S. Cl. ..... 175/6; 175/94

[58] Field of Search ..... 175/6, 26, 93, 94, 106, 175/122

[56] References Cited

U.S. PATENT DOCUMENTS 3,894,587 7/1975 Sourice .
4,215,544 8/1980 Stanwick ..... 175/6 X
4,256,191 3/1981 Jones .
4,298,077 11/1981 Emery .
4,646,853 3/1987 Sugden et al. ..... 175/94

FOREIGN PATENT DOCUMENTS 8405794 2/1984 Fed. Rep. of Germany .
2146531 2/1973 France .
83/00183 1/1983 PCT Int'l Appl. .
762749 12/1956 United Kingdom .

*Primary Examiner*—Jerome Massie
*Assistant Examiner*—William P. Neuder
*Attorney, Agent, or Firm*—Schweitzer & Cornman

[57] ABSTRACT

The invention concerns an arrangement for underwater drilling of foundations, comprising at least one cutter (27) and one pump (29) for discharge of excavated material, and hydraulic motors for driving the said cutter and the said pump.

It comprises an hydraulic turbine (16) capable of functioning by means of a fluid such as sea water, and an hydraulaic plant driven by the said turbine and designed for feeding the said hydraulic motors.

6 Claims, 2 Drawing Sheets

ARRANGEMENT FOR UNDERWATER DRILLING OF FOUNDATIONS

SUMMARY AND BACKGROUND OF THE INVENTION

The present invention concerns an arrangement for underwater drilling of foundations and, more particularly, an arrangement of the type comprising at least one cutter and a pump for discharge of the excavated material, and hydraulic motors for driving the said cutter and the said pump.

The exploitation of hydrocarbon beds at great depth increasingly calls for production platforms requiring the use of very heavy duty anchoring points. This is the case, for example, in so-called "taut cable" platforms.

Such anchoring points, capable, for example, of absorbing vertical or horizontal forces of the order of 1000 or 2000 tons, require construction in the bottom, under several hundreds of meters of water, of piles several square meters in section and several dozen meters in height, and therefore require the construction of corresponding boreholes.

Since rotary drilling is excluded for constructing such anchoring points, other solutions have already been proposed.

Thus, French Patent Application No. 85 14939 describes an arrangement comprising:

a drilling apparatus having a head linked by a hydraulic advancing jack to a member equipped with cutters, said apparatus being additionally equipped with a pump for discharge of excavated material and with hydraulic motors for driving the cutters and the pump;

a rigid tubular assembly comprising a pipeline for discharge of excavated material and pipelines for supplying the jack and the motors with hydraulic fluid;

means of connection between the head of the drilling apparatus and the lower end of the tubular assembly;

means of support placed on the sea floor in drilling head, designed to support means of locking the tubular assembly and means of suspension of the arrangement from a ship; means being provided for the supply of hydraulic fluid, and connecting pipes being provided between these means of supply of fluid and the end of the tubular assembly.

This arrangement, however, is limited, at very great depth, by the weight and the cost of the tubular assembly, and by the power required to secure the circulation of hydraulic fluid.

The present invention is designed to furnish a drilling arrangement better suited to very great depths.

For this purpose, the subject of the invention is an arrangement for underwater drilling of foundations, comprising at least one cutter and one pump for discharge of excavated material, and hydraulic motors for driving the said cutter and the said pump, characterized in that it comprises an hydraulic turbine capable of functioning by means of a fluid such as sea water, and an hydraulic power plant driven by the said turbine and designed to feed the said hydraulic motors.

Unlike heretofore, the arrangement according to the invention therefore comprises its own power plant, consisting of the hydraulic plant. The primary energy is supplied very simply from the service ship in the form, for example, of sea water under pressure, which may be obtained, for example, by means of mud drilling pumps with which all drilling ships are equipped.

In addition, the power necessary is considerably reduced since there is no longer any circulation of hydraulic fluid between the arrangement and the surface, but only injection at the inlet of the turbine of fluid such as sea water under pressure, which is then evacuated at the bottom of the borehole.

Moreover, it will be noted that the arrangement according to the invention requires no transfer of electric power between the surface and the bottom and consequently avoids the use of a heavy duty cable which presents problems difficult to solve because of the depth of exploitation considered.

In a preferred embodiment, the arrangement according to the invention comprises two cutters with horizontal shafts turning in reverse direction.

To accomplish regulation of the speed of the turbine as simply as possible, there may be provided a discharge valve opening under the effect of an increase in pressure at the inlet to the turbine caused by excessive speed.

The discharge of the turbine preferably is directed over the tools of the cutter, so as to secure cleaning thereof.

The hydraulic plant may comprise a plurality of hydraulic pumps, for example one per motor, driven by the said turbine by way of a mechanical distribution box.

In one particular embodiment, the arrangement according to the invention may comprise a head forming a first distribution box for feed of the said turbine and discharge of the excavated material.

This head may be linked to the body of the arrangement by at least one advancing jack fed by the said hydraulic plant.

The head may in addition be linked by a two-line pipe to a second distribution box connected, on the one hand, to means for supplying the fluid feeding the turbine and, on the other, to a hose for evacuating excavated material.

DETAILED DESCRIPTION OF A PREFERRED EMBODIMENT OF THE INVENTION

Figure 1:
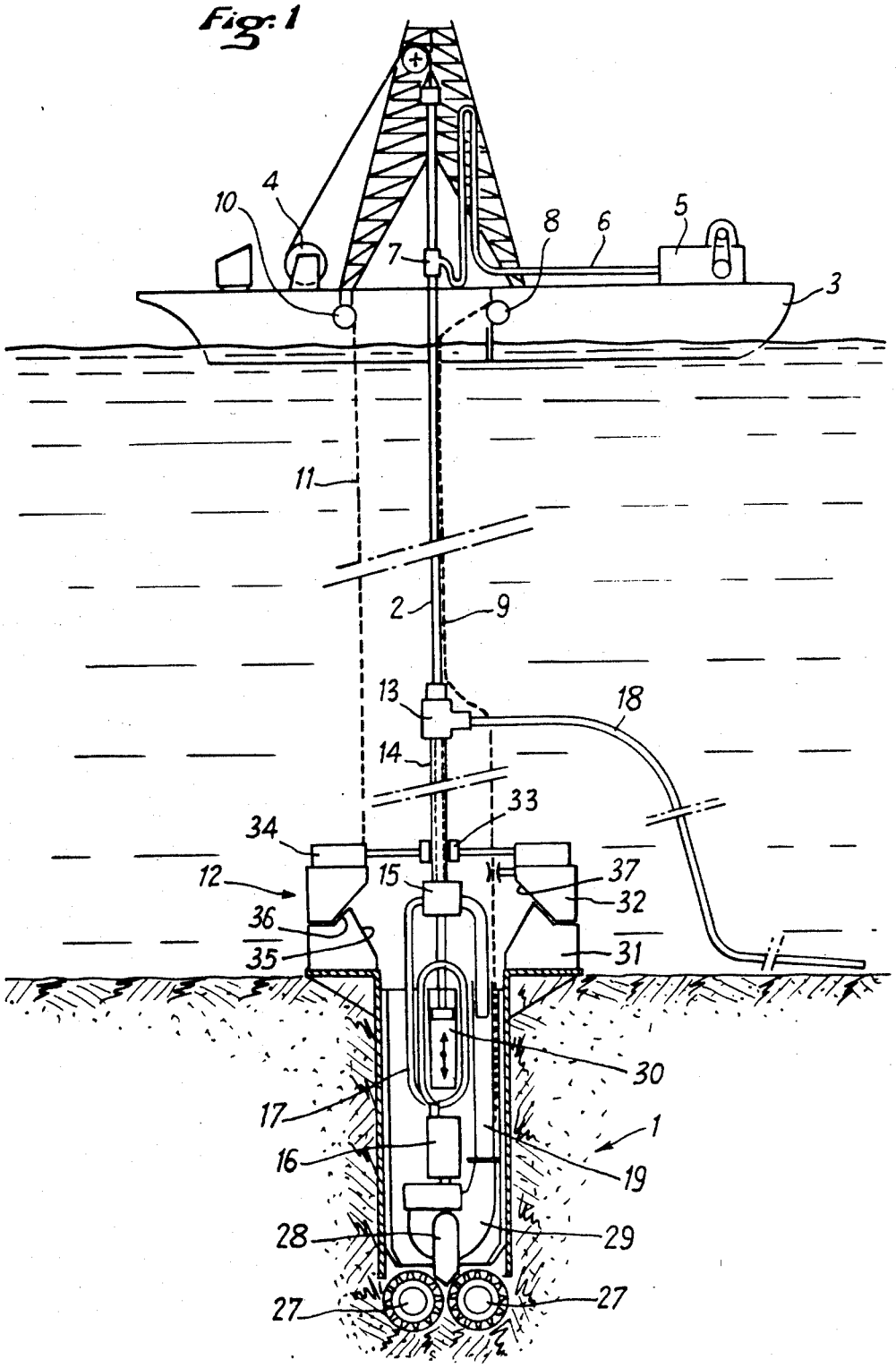
FIG. 1 is a general view of the arrangement according to the invention, and of a ship from which it is put into operation.
Figure 2:
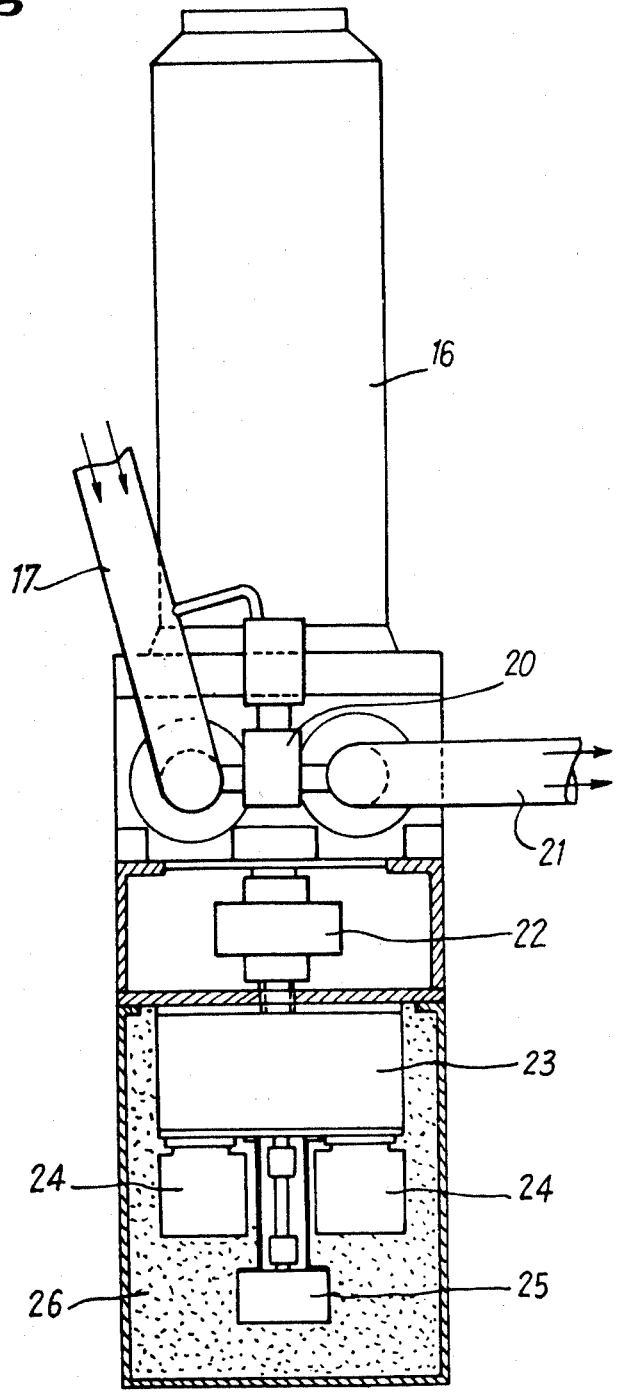
FIG. 2 is a view in elevation of the turbine/hydraulic plant assembly of the arrangement.

There will now be described, by way of non-limiting example, a particular embodiment of the invention, in reference to the accompanying schematic drawings, wherein FIG. 1 represents, in a general way, the drilling apparatus 1, linked by a pipe train 2, of the drill pipe type, to a service ship 3 which may, for example, be a dynamic positioning vessel.

The pipe train 2 is suspended from the ship by its upper part by means of a manoeuvering winch 4. In addition, the ship 3 carries a pump 5 of the mud pump type, linked by means of a hose 6 to an injection head 7 for the fluid under pressure, for example, sea water, in the pipe train 2.

A winch 8 permits the unwinding of a low-power electric cable 9, permitting feed of the electric members, such as the measuring instruments, the apparatus 1, and another winch 10 permits the unwinding of another electric cable 11, likewise low-power, permitting feed of the electric jacks of the guiding and locking means 12 to be described below.

The pipe train 2 is terminated at its lower part by a distribution box 13 linked by a two-line pipe 14 to another distribution box 15.

The two-line pipe 14 is made up of, example, two concentric pipes.

The line of the pipe 14 coming, by way of the distribution box 13, from the pipe train 2, is directed toward an hydraulic turbine 16, by way of the distribution box 15 and a flexible line 17.

The other line of the pipe 14 is linked at its upper part, by way of the distribution box 13, to a hose 18 for evacuation of excavated material and at its lower part, by way of the distribution box 15, to a telescopic pipe 19 for discharge of excavated material.

The pipe 14 has a length such that the distribution box 13 is located above the guiding and locking means 12 when the arrangement 1 is at the bottom of the borehole.

The turbine 16 is equipped with a valve 20 controlled by the inlet pressure of the turbine, i.e., the pressure in the line 17, for regulating the speed of the turbine depending upon the power requirement.

The discharge 21 of the turbine is directed by a pipe, not represented, toward the cutters, which will be described below, to clean the drilling picks.

The rotor of the turbine 16 is linked, by way of a coupling 22, to a mechanical distribution box 23 likewise acting as reducer, and equipped with a plurality of outlets capable of driving an assembly of hydraulic pumps 24.

The primary shaft of the distribution box 23 in addition carries a speed-control means 25.

The distribution box 23, the pumps 24 and the speed-control means 25 are placed in an oil housing 26.

The drilling arrangement 1 in addition comprises two horizontal-shaft cutters 27 turning in reverse direction, so as to guide the excavated material toward an aspiration nozzle 28 connected to a pump 29 for discharge of excavated material. The outlet of the pump 29 is connected to the discharge pipe 19.

The cutters 27 and the pump 29 are each driven by one of the hydraulic motors 24.

In addition, the distribution box 15 is linked to the body of the arrangement 1 by an advancing hydraulic jack 30, likewise led by one of the pumps 24.

The energy supply of the arrangement according to the invention may thus be summarized as follows:

The primary energy, in the present case consisting of sea water under pressure, is obtained beginning from the pump 5.

This sea water under pressure is transmitted to the arrangement 1 by way of the hose 5, the injection head 7, the pipe train 2, the distribution box 13, and one of the lines of the pipe 14.

This sea water under pressure then feeds the turbine 16 by way of the distribution box 15 and the line 17, and then is evacuated, preferably over the picks of the cutters 27.

The mechanical energy produced by the turbine 16 is transmitted by way of the coupling 22 to the hydraulic plant consisting of the distribution box 23 and the pumps 24.

The pumps 24 in turn supply energy to the hydraulic motors of the cutters 27 and the pump 29.

The guiding and locking assembly 12 is composed of a lower structure 31 and an upper structure 32, locking jaws 33 for the pipe 14 being mounted on the upper structure 32, from which they are operable by means of electric jacks 34 fed by the cable 11.

The lower structure 31 forms two assemblies of guiding surfaces 35 and 36, respectively. The guiding surfaces 35 form a reentry cone making it possible to guide the drilling arrangement 1 in a borehole already partially made when, for any reason whatever, it has had to be withdrawn. The guiding surfaces 36 cooperate with other guiding surfaces 37 provided on the upper structure 32 to secure, in the event of such reentry, a correct repositioning between the lower structure 31 and the upper structure 32.

Drilling is effected by a reciprocating action of the jack 30 and the jaws 33, as is described in French Patent Application No. 85 14939.

A variety of variants and modifications may of course be made in the preceding description, without thereby exceeding the scope or the spirit of the invention.

We claim:

1. An apparatus for underwater drilling of foundations and the like, comprising cutter means and a pump for discharge of excavated material, and hydraulic motors for driving the said cutter means and the said pump, characterized in that it comprises an hydraulic turbine capable of operating with the aid of a motive fluid such as sea water, an hydraulic pump means driven by the said turbine for driving the said hydraulic motors, a first distribution box having means for the supply of fluid under pressure to said turbine and for receiving discharge of excavated material from said cutter, supply conduit means for delivering motive fluid under pressure to said first distribution box, a supply line joining said first distribution box and said turbine, for delivering motive fluid under pressure from said first distribution box to said turbine, a return line joining said pump and said first distribution box delivering excavated material from said pump to said first distribution box, a second distribution box located above said first distribution box, a two-line pipe connecting said first and second distribution boxes, one line of said pipe comprising a portion of said supply conduit means, the other line of said pipe comprising a first discharge conduit for the flow of excavated material from said first distribution box to said second distribution box, and a second discharge conduit connected to said second distribution box for the discharge of said excavated material.

2. Apparatus according to claim 1, further characterized in that said cutter means comprises two cutters having horizontal shafts turning in reverse directions.

3. Apparatus according to claim 1, further characterized in that the hydraulic turbine is equipped with a controllable discharge valve for regulating said turbine.

4. Apparatus according to claim 1, further characterized in that said turbine is provided with a discharge outlet for the discharge of exhaust fluid onto the tools of the cutter.

5. Apparatus according to claim 1, further characterized in that the said hydraulic pump means comprises a plurality of hydraulic pumps driven by the said turbine by way of a mechanical distribution box.

6. Apparatus according to claim 1, further including at least one advancing jack, fed by the said hydraulic pump means, for positioning said apparatus.

* * * * *